US010843908B2

(12) United States Patent
Herse

(10) Patent No.: US 10,843,908 B2
(45) Date of Patent: Nov. 24, 2020

(54) TOWER CRANE

(71) Applicant: Liebherr-Werk Biberach GmbH, Biberach an der Riss (DE)

(72) Inventor: Thomas Herse, Biberach (DE)

(73) Assignee: LIEBHERR-WERK BIBERACH GMBH, Biberach an der Riss (DE)

( * ) Notice: Subject to any disclaimer, the term of this patent is extended or adjusted under 35 U.S.C. 154(b) by 207 days.

(21) Appl. No.: 15/741,831

(22) PCT Filed: Jul. 6, 2016

(86) PCT No.: PCT/EP2016/001162
§ 371 (c)(1),
(2) Date: Jun. 4, 2018

(87) PCT Pub. No.: WO2017/005365
PCT Pub. Date: Jan. 12, 2017

(65) Prior Publication Data

US 2018/0273353 A1 Sep. 27, 2018

(30) Foreign Application Priority Data

Jul. 6, 2015 (DE) ..... 10 2015 008 771

(51) Int. Cl.
*B66C 23/72* (2006.01)
*B66C 23/16* (2006.01)

(52) U.S. Cl.
CPC ..... *B66C 23/72* (2013.01); *B66C 23/16* (2013.01)

(58) Field of Classification Search
CPC ..... B66C 23/72; B66C 23/74; B66C 23/76; E02F 9/18; B62D 49/085
See application file for complete search history.

(56) References Cited

U.S. PATENT DOCUMENTS

| | | | | |
|---|---|---|---|---|
| 3,003,785 | A * | 10/1961 | Straszheim | B62D 49/0628 280/759 |
| 3,032,352 | A * | 5/1962 | Barrett | B62D 49/085 280/759 |
| 4,344,716 | A * | 8/1982 | Sigal | E04B 1/2403 403/13 |
| 9,457,997 | B2 | 10/2016 | Dorzbach et al. | |
| 2012/0153605 | A1 * | 6/2012 | Hetzel | B66C 23/74 280/755 |

FOREIGN PATENT DOCUMENTS

| | | | | |
|---|---|---|---|---|
| CN | 104030175 | A | 9/2014 | |
| DE | 102011118926 | B3 | 5/2013 | |
| EP | 1630122 | A1 | 3/2006 | |
| EP | 1655261 | A1 | 5/2006 | |
| EP | 1840076 | A1 * | 10/2007 | B66C 23/72 |

(Continued)

OTHER PUBLICATIONS

ISA European Patent Office, International Search Report Issued in Application No. PCT/EP2016/001162, dated Oct. 5, 2016, WIPO, 6 pages.

*Primary Examiner* — Michael R Mansen
*Assistant Examiner* — Juan J Campos, Jr.
(74) *Attorney, Agent, or Firm* — McCoy Russell LLP

(57) ABSTRACT

The invention relates to a tower crane with a crane tower and a jib mounted thereon as well as a counter-jib, wherein the length of the counter-jib is defined by the number of the counterweights received.

12 Claims, 2 Drawing Sheets

(56) References Cited

FOREIGN PATENT DOCUMENTS

| | | | | | |
|---|---|---|---|---|---|
| ES | 2264334 | A1 | | 12/2006 | |
| GB | 1161921 | A | * | 8/1969 | ..... B62D 37/04 |
| JP | H0318089 | U | | 2/1991 | |
| JP | H11165985 | A | | 6/1999 | |
| KR | 20120042115 | A | | 5/2012 | |

* cited by examiner

TOWER CRANE

CROSS-REFERENCE TO RELATED APPLICATIONS

The present application is a U.S. National Phase of International Patent Application Serial No. PCT/EP2016/001162, entitled "TOWER CRANE," filed on Jul. 6, 2016. International Patent Application Serial No. PCT/EP2016/001162 claims priority to German Patent Application No. 10 2015 008 771.1, filed on Jul. 6, 2015. The entire contents of each of the above-mentioned applications are hereby incorporated by reference in their entirety for all purposes.

TECHNICAL FIELD

The invention relates to a tower crane with a crane tower and a jib mounted thereon as well as a counter-jib.

BACKGROUND AND SUMMARY

The ballasting of the counter-jib of tower cranes, particularly rotating tower cranes, is well known. Usually, the counterweights for a trolley jib crane are hooked perpendicular into a dedicated opening. In doing so, the counterweights only support their net weight and introduce it into the steel construction of the counter-jib. For secure assembly of the counterweights, they have to be accessible from both sides.

For example, the mentioned opening is formed by a rectangular cavity of the steel structure of the counter-jib. The positioning of the counter-elements within this opening causes them to be completely enclosed by the steel structure of the counter-jib. However, a disadvantage of the known structure with fixed ballast attachment points is the lack of flexibility during the mounting of various ballast elements or an existing limitation of the employable quantity of ballast elements to be received, respectively. This makes a ballasting adapted to the jib length difficult.

Furthermore, the frame-like ballasting consistently results in a constant counter-jib length which is defined by the steel structure itself. This limitation is unfavorable, particularly with short jib lengths, since it would also be desirable to shorten the counter-jib. Namely, shorter jib lengths of the counter-jib mean advantages in the non-operational state, such as when rotating in the wind. Furthermore, a short counter-jib length would also be advantageous for the crane transportation, particularly for the container transportation.

In the event of long jib lengths, longer counter-jib lengths would be advantageous to evenly distribute the ballasting to the rotary mechanism of top-slewing cranes. This facilitates the dimensioning of the rotary mechanism used.

Thus, the present invention has the aim to demonstrate a suitable solution for a flexible counter-jib with configurable length.

This objective is solved by a tower crane according to the features disclosed embodiments.

According to the invention, a tower crane is suggested where the length of the counter-jib is defined by the number of counterweights received. Unlike in the state of the art, these are no longer hooked into a dedicated opening, but at least one counterweight will be attached to a free end of the counter-jib. Any further counterweight is preferably suspended directly or indirectly to this first counterweight. The resulting length of the ballasted counter-jib results from the number of counterweights attached.

The employed jib may be a trolley jib crane with counter-jib.

This possibility allows to react particularly flexibly to the equipped jib length. Short jib lengths require a reduced number of counterweights which may also reduce the counter-jib length. A short counter-jib length is particularly advantageous when "rotating in the wind" in a non-operational state of the crane or even in the event of cramped construction site conditions. In contrast, due to the required high number of counterweights, a long counter-jib length is achieved in the case of long jib lengths which is advantageous for the economic dimensioning of the rotary mechanisms since there is a more uniform ballasting at the slewing ring.

This flexible arrangement of the counterweights also provides new opportunities for designing and dimensioning the individual ballast elements. For example, various ballast element sizes may be employed in this context to achieve a greater flexibility when adapting the jib length. With a particular design of individual counterweights, the resulting wind surface of the ballasted counter-jib may be intentionally varied, particularly enlarged.

According to a preferred embodiment of the invention, only one counterweight is directly connected or connectable to the steel structure of the counter-jib. Any further counter-ballast elements are mounted, preferably suspended, to this counterweight. Thus, any further ballast element is self-supporting, i.e. they are exclusively connected to one another and not to the steel structure of the jib. Thus, the first counterweight directly mounted to the steel structure not only supports its net weight, but also the sum of the further counterweights.

Particularly preferably, the counterweights are successively stacked or suspended in counter-jib direction, particularly, they are each successively suspended in a perpendicular installation position.

The attachment of the individual counterweights to one another or the attachment of the first counterweight at the crane itself can preferably be realized by at least one cantilevered panel, particularly in the form of a cleat, at the ballast element. The panel or the cleat cantilevers from a surface of the counterweight which is transverse to the longitudinal axis of the jib in the direction of the counter-jib and serves for supporting on an appropriate bearing point of the steel structure or a foregoing counterweight, preferably on a horizontal support surface. Through this panel or cleat, the counterweights are put from above onto the front ballast element or the crane structure during the assembly.

Preferably, the tension is ensured by a suitable connecting means, preferably by at least one pull tab or at least one rigid hook. A respective attachment rod which extends transversely to the jib direction, particularly in the horizontal direction, serves as a counter-element for ensuring the tension.

According to a preferred embodiment, the bearing point of the counterweights is formed through a recess on the upper side of the elements, wherein particularly preferably the horizontal bottom surface of the recess serves as a bearing point. The panel(s) or cleat(s) of the ballast element located behind it may be put from above onto the bottom surface of the recess.

According to a particularly preferable design, the recess penetrates the entire upper side of the counterweight in counter-jib direction. In the event of an arrangement of individual counterweights, the recesses are located successively in line so that a continuous channel on the upper side of the ballast elements is advantageously obtained. This channel may optimally be used as a platform through which the ballast elements are easily accessible for assembly purposes. Furthermore, the attachment rods for ensuring the tension may simultaneously be used as a railing of the platform.

Previously, it has already been pointed out that the novel structure of the counter-jib without fixed fixation points gets along with the majority of the ballast elements and thus offers more design-related freedom regarding the shaping and dimensioning of the counterweights. For example, the counterweights may be designed identically or at least one part of the counterweights may have various shapings. Counterweights with variable thickness or width offer a higher flexibility when ballasting. At the same time, the resulting wind attack surface of the counter-jib may also be influenced by the variable shaping. By using very thick counterweights, the wind attack surface may be increased artificially.

In a further preferred design of the invention, one or more counterweights may be surrounded at least partially by a steel frame. The steel frame not only has a supporting function, but also serves as a protection during transportation or assembling. It is also conceivable that the steel frame serves as a permanent shuttering already during manufacturing the counterweights.

In addition to the tower crane, the invention also relates to an individual counterweight for ballasting a counter-jib of a tower crane according to the present invention. Preferably, the counterweight comprises at least one cantilevered panel, particularly in the form of at least one cleat, to store the counterweight on a horizontal bearing point. Furthermore, preferably at least one connecting means may be provided for manufacturing a tensile connection. For example, suitable connecting means are designed in the form of a tab or a rigid hook. Furthermore, the counterweight may comprise an appropriate counter element for receiving the tab or the rigid hook of an adjacent counterweight, preferably in the form of an attachment rod.

In a preferred embodiment of the counterweight, it provides for a bearing point of storing the cantilevered panels of an adjacent counterweight. The bearing point is particularly formed by a recess of the upper side of the ballast, wherein this recess preferably extends in the mounting position in jib direction continuously on the surface through the counterweight. It is also conceivable that the ballast element is equipped with a frame-like enclosure which is preferably made of steel. The frame construction may have a supporting function as well as a protecting function against possible transport or mounting damages. At the same time, this frame structure may also serve as a permanent shuttering during manufacturing the counterweight.

Overall, the additional costs incurred for the more complex manufacturing of such counterweights may be compensated by the associated savings at the counter-jib. Here, particularly at the counter-jib, the construction of necessary platforms as well as a supporting structure which is possibly necessary for the counterweights may be eliminated.

Advantageously, the counterweight may also be designed without a cleat, if the other components, such as the hook, etc., are designed accordingly.

Further advantages and features of the invention are to be explained in further detail in the following using an example embodiment which is represented in the figures.

In the figures:

DETAILED DESCRIPTION

Figure 1:
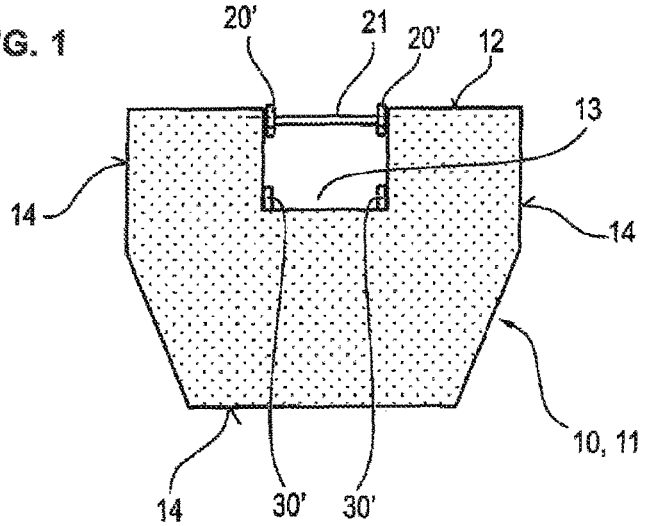
FIG. 1: a rear view of the counterweight of the invention.

The idea according to the invention of the present application is that the counterweights are designed self-supporting for the maximum possible counterweight ballasting for compensating the torques of the tower crane.

In doing so, only the innermost counterweight 10 is connected to the rear end of the steel structure of the counter-jib 100. Any further counterweights 11 are connected to one another without being required to connect them directly to the steel structure of the counter-jib 100. This has the advantage that the steel structure of the counter-jib 100 may be designed really short which is particularly advantageous for the transportation of the tower crane.

Moreover, the length of the counter-jib 100 may be optimally adjusted to the equipped jib length of the jib 120 of the tower crane 1 with a crane tower 110 using the number of ballasted counterweights 10, 11. For example, short jib lengths get a short counter-jib due to the small number of necessary counterweights 10, 11 which is advantageous for the non-operational state, particularly regarding the function "rotating in the wind", as well as in the event of cramped construction site conditions. In contrast, long jib lengths get a long counter-jib length due to the large number of required counterweights which is advantageous for the economic dimensioning of the rotary mechanisms.

FIG. 1 shows the counterweight 10, 11 according to the invention in a rear view. In this perpendicular installation position, it is mounted to the steel structure or a front counterweight from the back. In the example embodiment, the first 10 and any further counterweights 11 are identically designed according to FIG. 1. The counterweights 10, 11 provide for a hexagonal basic shape. Within the context of the invention, the counterweights may of course have every other basic shape. For mounting on the steel structure or a front counterweight 10, 11, two cleats 30 as well as two pull tabs 20 are available as attachment means (see FIG. 2). The two cleats 30 cantilever into the shown perpendicular position of the elements 10, 11, preferably in the upper third of the front side parallel to one another on the left and right side. Similarly, two pull tabs 20 extend parallel to each other, each perpendicular to the ground surface, to the front, wherein one pull tab 20 is mounted each on the right and left side near the top edge. Furthermore, the pull tabs 20 are pivotably hinged to the counterweight 10, 11.

Figure 2:
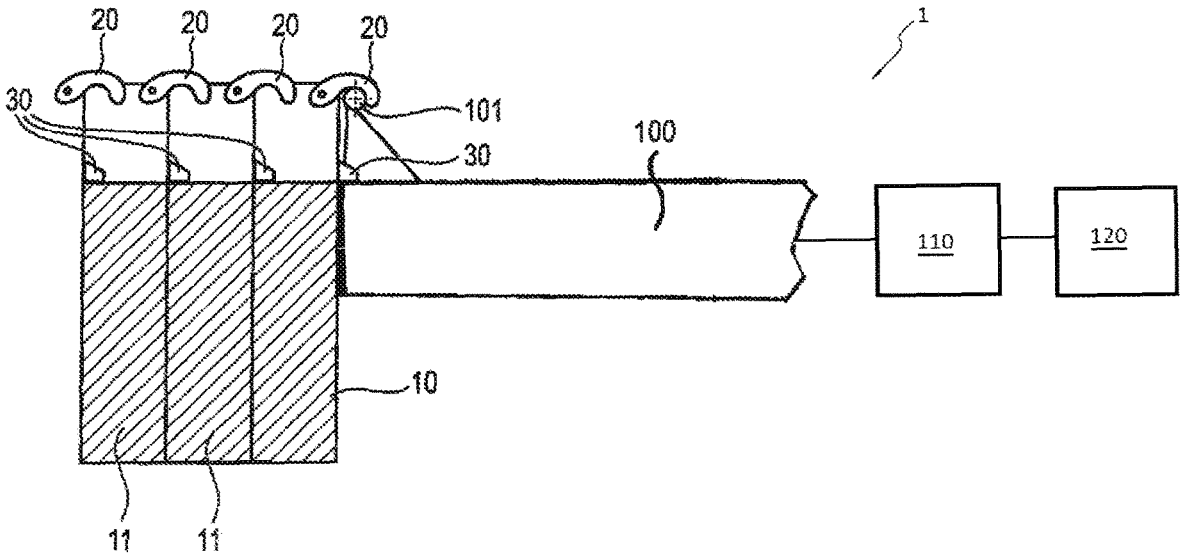
FIG. 2: a detailed view of the counter-jib of the tower crane according the invention in a side view with mounted counterweights.

In FIG. 2, it is also apparent that the first counterweight 10 is put from above onto the steel structure of the counter-jib 100 using the cleat 30 and accordingly secured using the pull tab 20. In doing so, the cleats 30 are put onto a horizontal bearing surface of the steel structure and the tabs 20 are hooked on a suitable attachment rod 101 of the counter-jib 100.

Any further counterweight 11 is also put from above onto the respective front counterweight 10, 11 using their cleats 30 as well as the pull tabs 20. As a result, a plurality of counterweights 10, 11 is stacked successively in counter-jib direction such that the entire jib length of the counter-jib 100 is defined by the number of the counterweights 10, 11.

For receiving the cleats 30 of the rear counterweight 11, each counterweight 10, 11 also comprises an appropriate bearing point to be able to put the cleats 30 from above onto the horizontal bearing surface. These bearing surface is formed by a continuous recess 13 of the upper side 12, as depicted in FIG. 1, for example. The recess is continuous in the longitudinal direction which results in the upper side 12 forming a rectangular channel which extends in the longitudinal direction of the jib whose horizontal bottom surface serves as the bearing point for receiving the cleats 30. In the illustration of FIG. 1, the cleats of the counterweight 11 located behind are marked with the reference number 30'. At the top edge of the recess 13, an attachment rod 21 extends transversely to the jib direction. At this attachment rod 21, the pull tabs 20' of the adjacent counterweight 11 may be hooked into.

A particular advantage of this arrangement is that the steel structure of the counter-jib 100 has no given fixed points for the various counterweights 11. This allows an optimal counterbalancing of the weight balance of the counter-jib 100 with various weights 10, 11. For example, it may be conceivable that the counterweights 10, 11 have various basic shapes on the one side, but particularly differ regarding various widths, i.e. the thickness in jib direction. This allows a particularly flexible configuration of the counterweight. It is furthermore conceivable that especially the rearmost counterweight 11 is designed particularly long to intentionally increase the resulting wind attack surface of the counter-jib 100.

Furthermore, the counterweights 10, 11 may also be employed across multiple crane types as the fixed point to the steel structure 100 may be standardized. The multiple application is advantageous for the flexible usage within rental pools and creates economies of scale during manufacturing.

When the counterweights are connected to one another using the tensile connection and cleat bearing, a lateral platform is no longer necessary as it is formed by the recesses 13 of the counterweights 10, 11 extending in line. This hidden arrangement of the platforms within the counterweights 10, 11 may lead to a smaller wind surface and thus to reduced costs for the counter-jib 100. Furthermore, a respective and distinctive product design may be implemented. The attachment rods 21 may be used as a railing for the platform at the same time.

Figure 3:
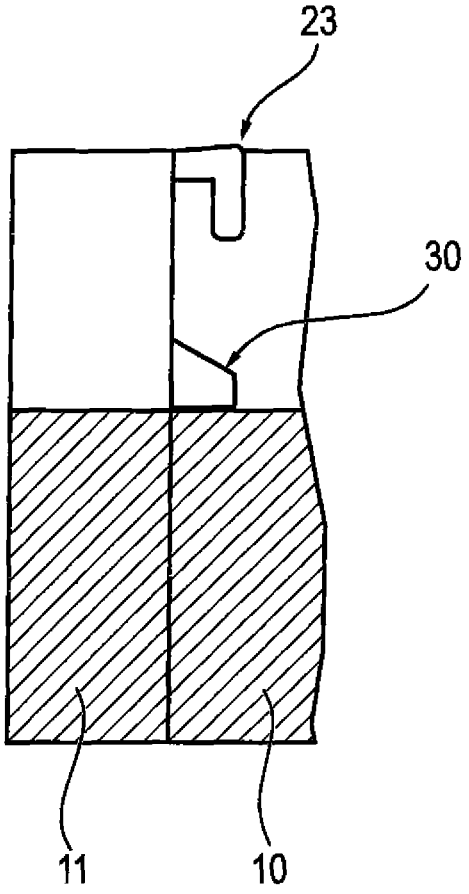
FIG. 3: an alternative embodiment of the counterweights according to the invention.

Alternatively to the pivotable pull tab 20 according to FIG. 2, a stationary horizontal safety hook 23 according to FIG. 3 may be employed as well.

Additionally, the counterweights 10, 11 may be designed with a supporting steel frame 14 which passes around the perimeter of the counterweight 10, 11. Only the upper side 12 is recessed. Thus, the steel frame 14 not only has a supporting function, but also serves for the protection against transport and mounting damages. Furthermore, the steel frame may serve as a permanent shuttering already during manufacturing of the counterweights 10, 11. The additional costs incurred for the more complex ballast elements 10, 11 may be compensated with an advantageous construction by savings at the counter-jib 100, particularly due to the elimination of the platforms and the support structure for the counterweights.

The invention claimed is:

1. A tower crane comprising:

a crane tower and a jib mounted thereon; and a counter-jib, wherein a length of the counter-jib is defined by a number of counterweights;

wherein a first counterweight is mounted to a free end of a steel structure of the counter-jib, and any other counterweights are directly connected to the first counterweight or to one another;

wherein at least one counterweight of the number of couterweights comprises at least one cantilevered panel to retain the at least one counterweight at a respective bearing point of the steel structure of the counter-jib or a further counterweight;

wherein the at least one counterweight additionally comprises at least one tab or at least one rigid hook establishing a tensile connection with the steel structure or the further counterweight; and wherein at least one attachment rod extending transversely to a jib direction is provided at the steel structure or the further counterweight as a counter-element for the at least one tab or at least one rigid hook.

2. The tower crane according to claim 1, wherein at least two counterweights of the number of counterweights in a counter-jib direction are mounted successively.

3. The tower crane according to claim 1, wherein the bearing point of at least one counterweight is formed by a recess of an upper side of the counterweight.

4. The tower crane according to claim 3, wherein a continuous platform is formed when successively arranging multiple counterweights through the recess.

5. The tower crane according to claim 4, wherein the counterweights are identical.

6. The tower crane according to claim 4, wherein at least one of the counterweights is surrounded at least partially by a steel frame.

7. The tower crane of claim 4, wherein at least one part of the counterweights differ in at least one of thickness, perimeter, shape, or type of material used.

8. The tower crane of claim 3, wherein the recess extends in the jib direction continuously through the counterweight.

9. A counterweight for ballasting a counter-jib of a tower crane, wherein the counterweight comprises at least one cantilevered panel to retain the counterweight on a horizontal bearing point, as well as at least one tab or at least one rigid hook, for establishing a tensile connection with an attachment rod;

wherein the counterweight comprises a bearing point for retaining the cantilevered panel of a further counterweight, wherein the bearing point is formed by a recess on an upper side of the counterweight and the recess extends in a mounting position in a jib direction continuously on the upper side through the counterweight;

wherein the counterweight is provided with a frame enclosing a ballast element; and wherein the frame provides support to the ballast element.

10. The counterweight according to claim 9, wherein the frame enclosure is made of steel.

11. The counterweight according to claim 9, wherein the counterweight does not have a cleat.

12. The counterweight of claim 9, wherein the cantilevered panel is in the form of at least one cleat.

* * * * *